US007537326B2

(12) United States Patent
Jones

(10) Patent No.: US 7,537,326 B2
(45) Date of Patent: May 26, 2009

(54) SOLID INK STICK WITH CODED SENSOR FEATURE

(75) Inventor: Brent Rodney Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 585 days.

(21) Appl. No.: 11/473,656

(22) Filed: Jun. 23, 2006

(65) Prior Publication Data

US 2007/0296783 A1 Dec. 27, 2007

(51) Int. Cl.
*B41J 2/175* (2006.01)
*B41J 29/393* (2006.01)

(52) U.S. Cl. ..... 347/88; 347/19

(58) Field of Classification Search ..... 347/19, 347/85, 88, 95, 99
See application file for complete search history.

(56) References Cited

U.S. PATENT DOCUMENTS 5,223,860 A 6/1993 Loofbourow et al.
5,442,387 A 8/1995 Loofbourow et al.
5,861,903 A 1/1999 Crawford et al.
5,975,688 A 11/1999 Kanaya et al.
6,056,394 A 5/2000 Rousseau et al.
6,213,600 B1 4/2001 Kobayashi et al.
6,317,149 B1 * 11/2001 Mochida et al. ..... 347/173
6,761,443 B2 7/2004 Jones
6,820,815 B2 * 11/2004 Meunier et al. ..... 235/487
6,840,613 B2 1/2005 Jones
6,924,835 B1 * 8/2005 Silverbrook et al. ... 348/207.99

FOREIGN PATENT DOCUMENTS

EP 1359014 A1 11/2003
EP 1359015 A1 11/2003
EP 1359024 A1 11/2003
EP 1731315 A1 12/2006

* cited by examiner

*Primary Examiner*—Anh T. N. Vo
(74) *Attorney, Agent, or Firm*—Maginot, Moore & Beck LLP

(57) ABSTRACT

An ink stick for use in a phase change ink imaging device is provided. The ink stick comprises a three dimensional ink stick body having an exterior surface and a coded sensor feature formed on the exterior surface for conveying variable control/attribute information pertaining to the ink stick to a control system of the imaging device. The coded sensor feature includes a plurality of code elements configured to actuate one or more sensors in the ink loader to generate a coded pattern of signals corresponding to the variable control information to be conveyed to the control system. Each code element of the plurality of code elements is configured to actuate the one or more sensors to produce a predetermined signal part of the coded pattern of signals based on a dimension of the code element.

20 Claims, 6 Drawing Sheets

SOLID INK STICK WITH CODED SENSOR FEATURE

CROSS-REFERENCE TO RELATED APPLICATIONS

Reference is made to commonly-assigned copending U.S. patent applications Ser. No. 11/473,610, entitled "Ink Loader for Interfacing with Solid Ink Sticks", and Ser. No. 11/473,632, entitled "Solid Ink Stick with Interface Element" and Ser. No. 11/473,611, entitled "Solid Ink Stick with Enhanced Differentiation", all of which are filed concurrently herewith, the entire disclosures of which are expressly incorporated by reference herein.

TECHNICAL FIELD

This disclosure relates generally to phase change ink jet printers, the solid ink sticks used in such ink jet printers, and the load and feed apparatus for feeding the solid ink sticks within such ink jet printers.

BACKGROUND

Solid ink or phase change ink printers conventionally use ink in a solid form, either as pellets or as ink sticks of colored cyan, yellow, magenta and black ink fed into shape coded openings. These openings fed generally vertically into the heater assembly of the printer where they were melted into a liquid state for jetting onto the receiving medium. The pellets were fed generally vertically downwardly, using gravity feed, into the ink loader. These pellets were elongated with separate multisided shapes each corresponding to a particular color.

Solid ink sticks have been typically either gravity fed or spring loaded into a feed channel and pressed against a heater plate to melt the solid ink into its liquid form. These ink sticks were shape coded and of a generally small size. One system used an ink stick loading system that initially fed the ink sticks into a preload chamber and then loaded the sticks into a load chamber by the action of a transfer lever. Earlier solid or hot melt ink systems used either a flexible web of hot melt ink that was incrementally unwound and advanced to a heater location or particulate hot melt ink that was delivered by vibrating the particulate into the melt chamber.

In previously known phase change ink jet printing systems, the interface between a control system for a phase change ink jet printer and a solid ink stick provided little information about the solid ink sticks loaded in the printer. As an example, previously known control systems are typically only able to sense when the first color (of the four colors) of solid ink in an ink loader reaches a "low" volume state or an "out of ink" state. Additionally, these control systems are generally not able to determine which of the colors caused the "low" or "out of ink" state or the fill status of the other colors of solid ink that have not caused the "low" or "out of ink" state.

Moreover, previously known control systems are limited in their ability to gain specific information about an ink stick that is currently loaded in the feed channels. For instance, control systems are not able to determine if the correct color of ink stick is loaded in a particular feed channel or if the ink that is loaded is compatible with that particular printer. Provisions have been made to ensure that an ink stick is correctly loaded into the intended feed channel and to ensure that the ink stick is compatible with that printer. These provisions, however, are generally directed toward excluding wrong colored or incompatible ink sticks from being inserted into the feed channels of the printer. For example, the correct loading of ink sticks has been accomplished by incorporating keying, alignment and orientation features into the exterior surface of an ink stick. These features are protuberances or indentations that are located in different positions on an ink stick. Corresponding keys or guide elements on the perimeters of the openings through which the ink sticks are inserted or fed exclude ink sticks which do not have the appropriate perimeter key elements while ensuring that the ink stick is properly aligned and oriented in the feed channel.

While this method is effective in ensuring correct loading of ink sticks in most situations, there are still situations when an ink stick may be incorrectly loaded into a feed channel of a printer. For example, world markets with various pricing and color table preferences have created a situation where multiple ink types may exist in the market simultaneously with nearly identical size/shape ink and/or ink packaging. Thus, ink sticks may appear to be substantially the same but, in fact, may be intended for different phase change printing systems due to factors such as, for example, market pricing or color table. In addition, due to the soft, waxy nature of an ink stick body, an ink stick may be "forced" through an opening into a feed channel. The printer control system, having no information regarding the configuration of the ink stick, may then conduct normal printing operations with an incorrectly loaded ink stick. If the loaded ink stick is the wrong color for a particular feed channel or if the ink stick is incompatible with the phase change ink jet printer in which it is being used, considerable errors and malfunctions may occur.

SUMMARY

An ink stick for use in a phase change ink imaging device is provided. The ink stick comprises a three dimensional ink stick body having an exterior surface and a coded sensor feature formed on the exterior surface for conveying variable control/attribute information pertaining to the ink stick to a control system of the imaging device. The coded sensor feature includes a plurality of code elements configured to actuate one or more sensors in the ink loader to generate a coded pattern of signals corresponding to the variable control information to be conveyed to the control system. Each code element of the plurality of code elements is configured to actuate the one or more sensors to produce a predetermined signal part of the coded pattern of signals based on a physical dimension of the code element. The code element dimensional attribute will hereafter be described as a depth and can be inset or extend outward but could also be a length, width or spacing between elements or any combination of stated or similar dimensional features.

In another embodiment, a system for an imaging device is provided. The system comprises a coded sensor feature formed on an exterior surface of an ink stick for conveying variable control/attribute information pertaining to the ink stick to a control system of the imaging device. The coded sensor feature includes a plurality of code elements configured to produce a coded pattern of signals corresponding to the variable control information to be conveyed to the control system. The coded pattern of signals is comprised of signal parts, each signal part corresponding to a depth of a code element. The system includes a sensor system for detecting the depth of each code element and generating the coded pattern of signals corresponding to the depths of the code elements. The system further includes a controller for receiving coded pattern of signals and decoding the coded pattern of signals to determine the variable control/attribute information to be associated with the ink stick.

In yet another embodiment, a method of feeding ink sticks in an ink loader of a phase change imaging device is provided. The method comprises first inserting one or more ink sticks into an ink loader of a phase change imaging device. The depths of the plurality of code elements formed into the exterior surface of the ink stick are then detected. A coded pattern of signals is generated that corresponds to the plurality of depths detected. The coded pattern of signals generated may then be decoded to determine variable control/attribute information to be associated with the ink stick.

DETAILED DESCRIPTION OF THE PREFERRED EMBODIMENT

Figure 1:
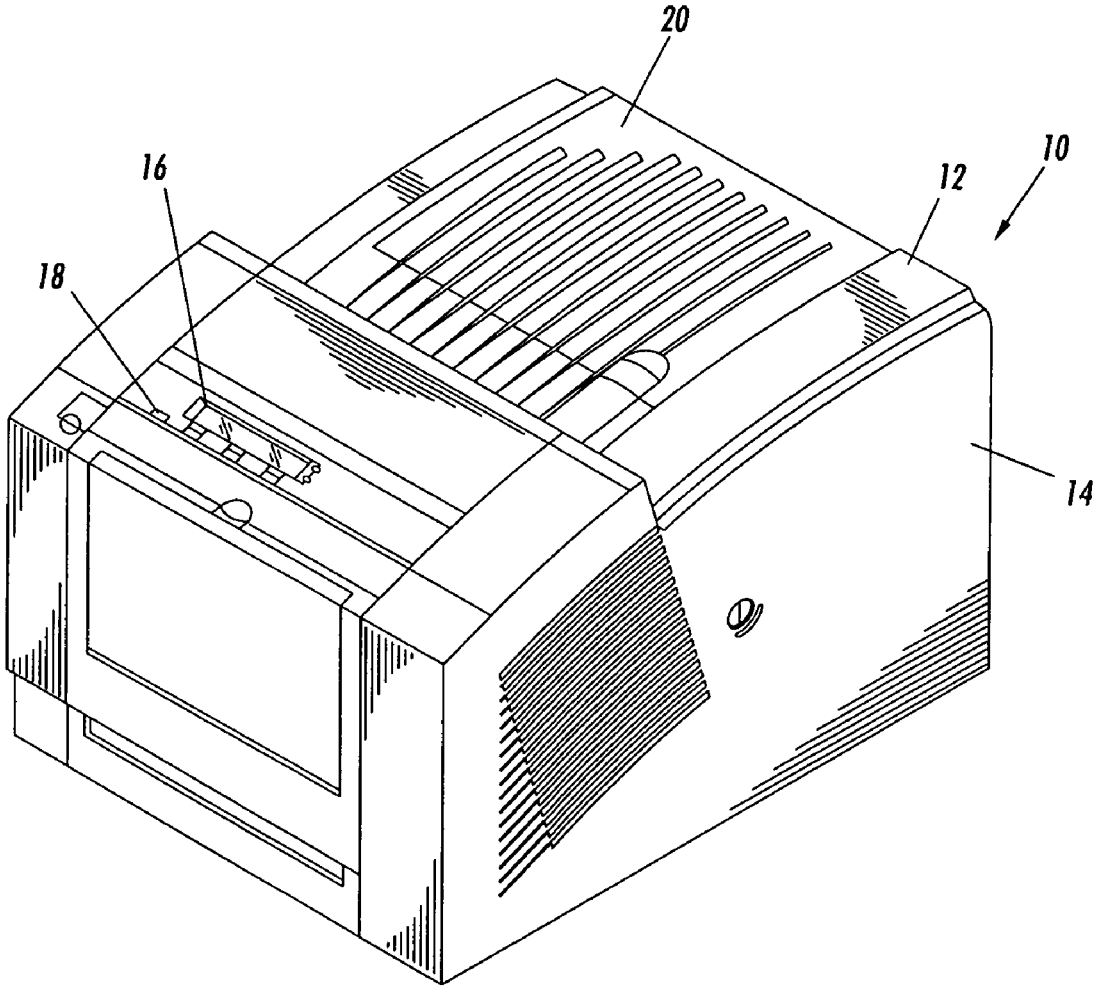
FIG. 1 is a perspective view of a phase change printer with the printer top cover closed.

For a general understanding of the present embodiments, reference is made to the drawings. In the drawings, like reference numerals have been used throughout to designate like elements. The ink loader described is typical across a number of printer models so is illustratively representative but alternative configurations may be developed in the future to expand the range and usefulness of the coded sensing opportunities of the ink stick concepts of the present invention.

FIG. 1 shows a solid ink, or phase change, ink printer 10 that includes an outer housing having a top surface 12 and side surfaces 14. A user interface, such as a front panel display screen 16, displays information concerning the status of the printer, and user instructions. Buttons 18 or other control elements for controlling operation of the printer are adjacent the front panel display screen, or may be at other locations on the printer. An ink jet printing mechanism (not shown) is contained inside the housing. An example of the printing mechanism is described in U.S. Pat. No. 5,805,191, entitled Surface Application System, to Jones et al., and U.S. Pat. No. 5,455,604, entitled Ink Jet Printer Architecture and Method, to Adams et al. An ink loader 100 delivers ink to the printing mechanism. The ink loader 100 is contained under the top surface of the printer housing. The top surface of the housing includes a hinged ink access cover 20 that opens as shown in FIG. 2, to provide the operator access to the ink loader 100.

Figure 2:
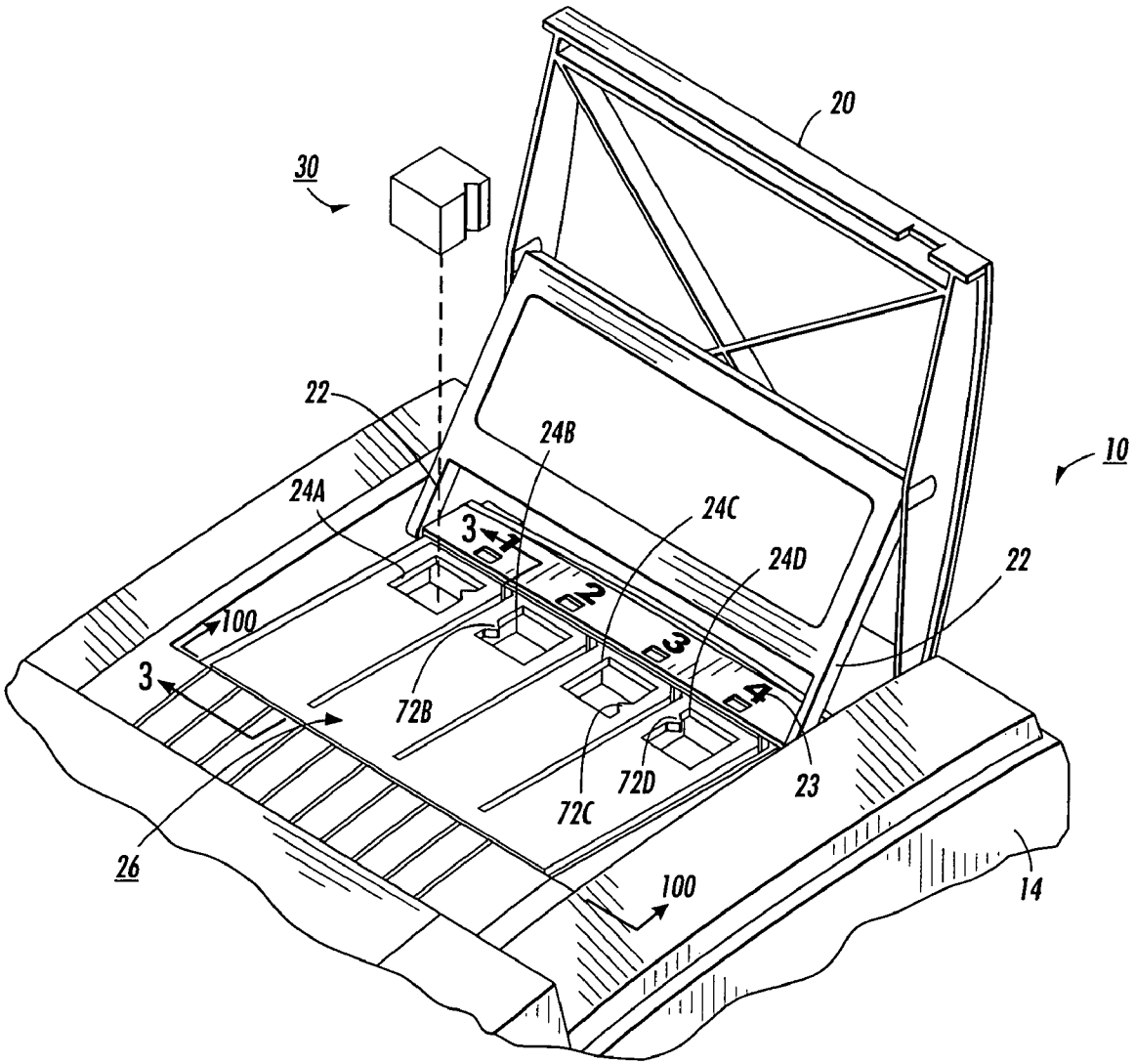
FIG. 2 is an enlarged partial top perspective view of the phase change printer with the ink access cover open, showing a solid ink stick in position to be loaded into a feed channel.
Figure 3:
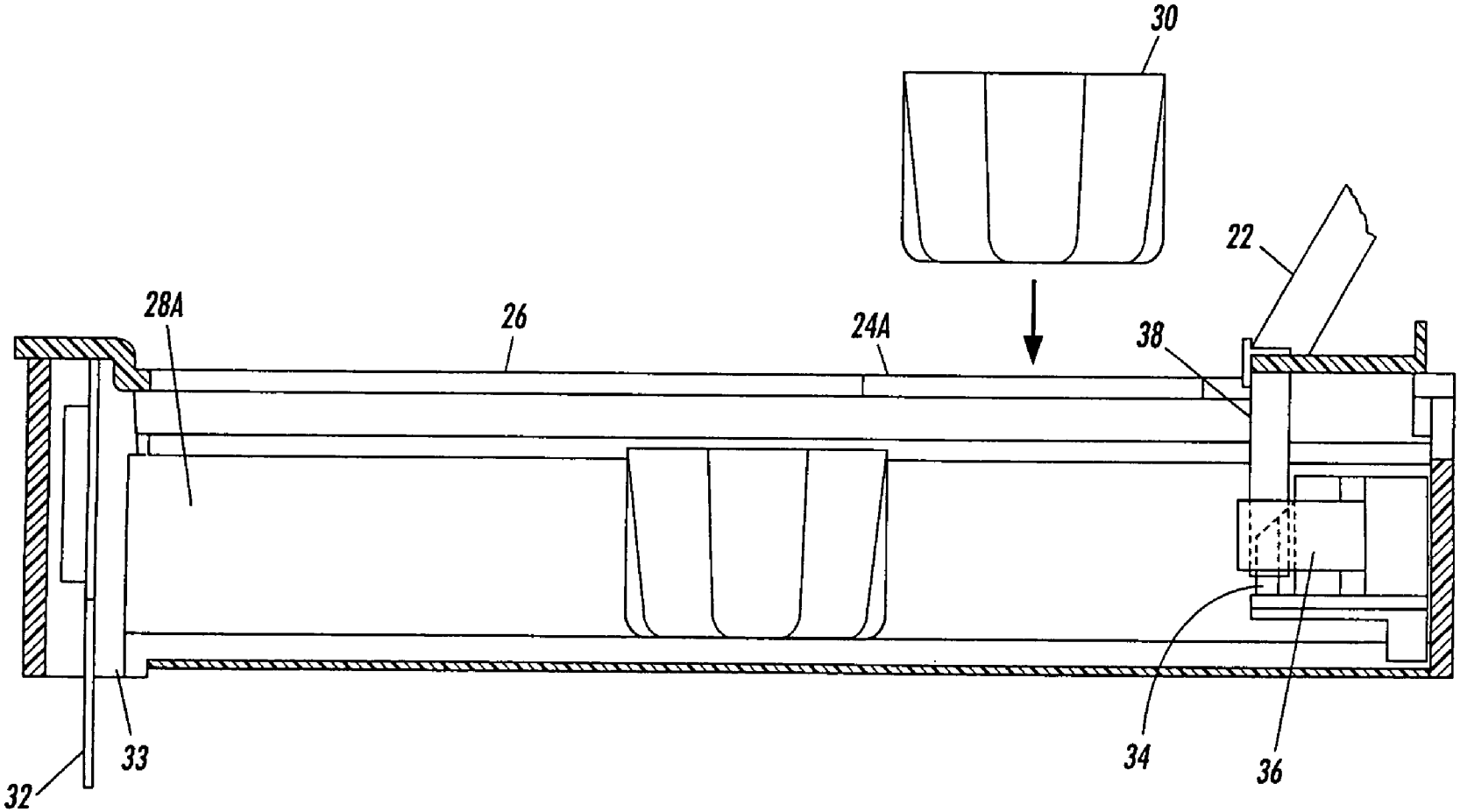
FIG. 3 is a side sectional view of a feed channel of a solid ink feed system taken along line 3-3 of FIG. 2.

FIG. 2 illustrates the printer 10 with its ink access cover 20 raised revealing an ink load linkage element 22 and an ink stick feed assembly or ink loader 100. In the particular printer shown, the ink access cover 20 is attached to an ink load linkage element 22 so that when the printer ink access cover 20 is raised, the ink load linkage 22 slides and pivots to an ink load position. The interaction of the ink access cover and the ink load linkage element is described in U.S. Pat. No. 5,861,903 for an Ink Feed System, issued Jan. 19, 1999 to Crawford et al. As seen in FIG. 2, the ink loader includes a key plate 26 having keyed openings 24. Each keyed opening 24A, 24B, 24C, 24D provides access to an insertion end of one of several individual feed channels 28A, 28B, 28C, 28D of the ink loader (see FIG. 3).

Each longitudinal feed channel 28 of the ink loader 100 delivers ink sticks 30 of one particular color to a corresponding melt plate 32. Each feed channel has a longitudinal feed direction from the insertion end of the feed channel to the melt end of the feed channel. The melt end of the feed channel is adjacent the melt plate. The melt plate melts the solid ink stick into a liquid form. The melted ink drips through a gap 33 between the melt end of the feed channel and the melt plate, and into a liquid ink reservoir (not shown). The feed channels 28A, 28B, 28C, 28D (see FIG. 3) have a longitudinal dimension from the insertion end to the melt end, and a lateral dimension, substantially perpendicular to the longitudinal dimension.

Each feed channel 28 in the particular embodiment illustrated includes a push block 34 driven by a driving force or element, such as a constant force spring 36 to push the individual ink sticks along the length of the longitudinal feed channel toward the melt plates 32 that are at the melt end of each feed channel. The tension of the constant force spring 36 drives the push block 34 toward the melt end of the feed channel. In a manner similar to that described in U.S. Pat. No. 5,861,903, the ink load linkage 22 is coupled to a yoke 38, which is attached to the constant force spring mounted in the push block. The attachment to the ink load linkage 22 pulls the push block 34 toward the insertion end of the feed channel when the ink access cover is raised to reveal the key plate 26. In the implementation illustrated, the constant force spring 36 can be a flat spring with its face oriented along a substantially vertical axis.

A color printer typically uses four colors of ink (yellow, cyan, magenta, and black). Ink sticks 30 of each color are delivered through a corresponding individual one of the feed channels 28A, 28B, 28C, 28D. The operator of the printer exercises care to avoid inserting ink sticks of one color into a feed channel for a different color. Ink sticks may be so saturated with color dye that it may be difficult for a printer operator to tell by the apparent color alone which color is which. Cyan, magenta, and black ink sticks in particular can be difficult to distinguish visually based on color appearance. The key plate 26 has keyed openings 24A, 24B, 24C, 24D to aid the printer operator in ensuring that only ink sticks of the proper color are inserted into each feed channel. Each keyed opening 24A, 24B, 24C, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 4:
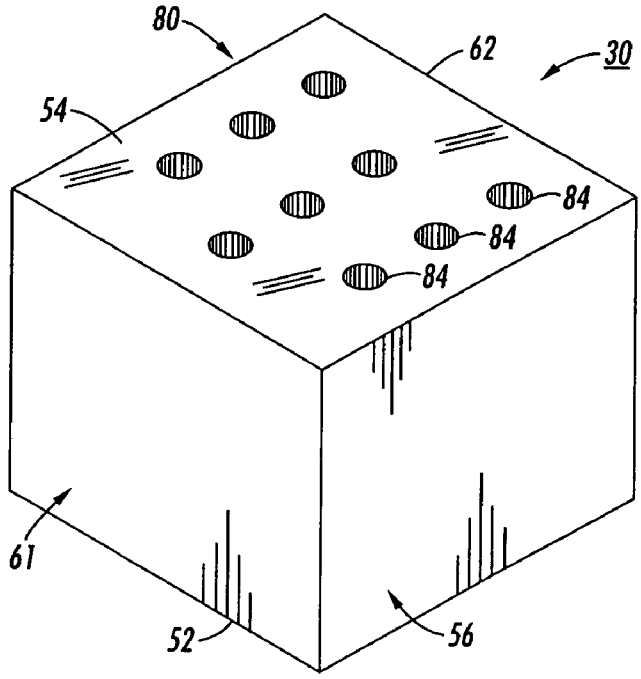
FIG. 4 is a perspective view of one embodiment of a solid ink stick.

An exemplary solid ink stick 30 for use in the ink loader is illustrated in FIG. 4. The ink stick is formed of a three dimensional ink stick body. The ink stick body illustrated has a bottom exemplified by a generally bottom surface 52 and a top exemplified by a generally top surface 54. The particular bottom surface 52 and top surface 54 illustrated are substantially parallel one another, although they can take on other contours and relative relationships. The surfaces of the ink stick body need not be flat, nor need they be parallel or perpendicular one another. However, these descriptions will aid the reader in visualizing, even though the surfaces may have three dimensional topography, or be angled with respect to one another. The ink stick body also has a plurality of side extremities, such as side surfaces 56 and end surfaces 61, 62. The illustrated embodiment includes four side surfaces, including two end surfaces 61, 62 and two lateral, side surfaces 56. For the illustrated stick, basic elements of the lateral side surfaces 56 are substantially parallel one another, and are substantially perpendicular to the top and bottom surfaces 52, 54. The end surfaces 61, 62 are also basically substantially parallel one another, and substantially perpendicular to the top and bottom surfaces, and to the lateral side surfaces. One of the end surfaces 61 is a leading end surface, and the other end surface 62 is a trailing end surface. The ink stick body may be formed by pour molding, injection molding, compression molding, or other known techniques.

Figure 5:
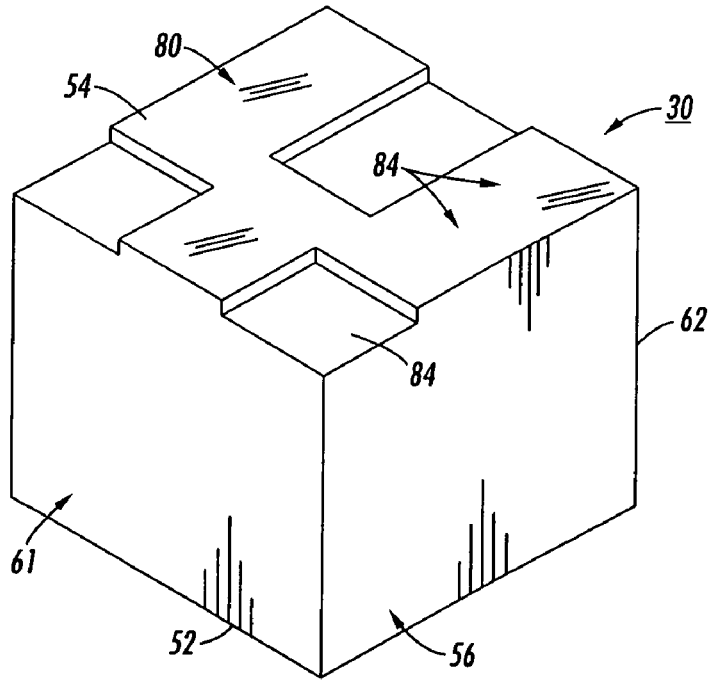
FIG. 5 is a perspective view of another embodiment of a solid ink stick.

The ink stick may include a coded sensor feature 80 for encoding variable control information or attribute information into the ink stick 30. The coded sensor feature 80 includes a plurality of code elements 84 formed in one or more surfaces of the ink stick 30. Each code element 84 of the coded sensor feature 80 is formed in a predetermined location on the ink stick 30 and is configured to actuate one or more sensors in a load or feed area of the ink loader. In the embodiments of FIGS. 4 and 5, the code elements 84 of the coded sensor feature 80 are shown on the top surface 54 of the ink stick 30 although the code elements 84 may be formed on any surface or more than one surface of the ink stick. The number and/or pattern of code elements 84 that may be formed into an ink stick 30 is only limited by the geometry of the ink sticks and sensor placement options in an ink loader.

The plurality of code elements 84 may be configured to interface with a sensor system in a feed channel of an ink loader to generate a coded signal pattern that corresponds to the variable control and/or attribute information. In one embodiment, the coded signal pattern encodes one or more code words. A code word may comprise one or more values, alphanumeric characters, symbols, etc. that may be associated with a meaning by an imaging device control system. The control/attribute information may be encoded into the coded sensor feature 80 by selecting the one or more code words to be indicated by the coded sensor feature 80 and implementing an encoding scheme such that the coded pattern of signals generated by the plurality of code elements corresponds to the one or more code words selected. A code word may be comprised of the signal inputs provided by one or more of the plurality of code elements 84. Thus, a plurality of code words may be generated by a code sensor feature 80.

Code words may be assigned to indicate control and/or attribute information that pertains to an ink stick. The code word may be may be read by an imaging device control system and translated into the control and/or attribute information pertaining to the ink stick that may be used in a number of ways by the control system. For example, the control system may use a code word as a lookup value for accessing data stored in a data structure, such as for example, a table. The data stored in the data structure may comprise a plurality of possible code words with associated information corresponding to each code word.

The control and/or attribute information that may be encoded into the coded sensor feature 80 may comprise attribute information pertaining to the ink stick, such as, for example, ink stick color, printer compatibility, or ink stick composition information, or may comprise control information pertaining to the ink stick, such as, for example, suitable color table, thermal settings, etc. that may be used with an ink stick. The encoded control and/or attribute information may be used by a control system in a suitably equipped phase change ink jet printer to control print operations. For example, an imaging device control system may receive and translate the code word into the appropriate control and/or attribute information pertaining to the ink stick and may then enable or disable operations, optimize operations or influence or set operation parameters based on this decoded information.

In one embodiment, each code element 84 actuates one or more sensors in a feed channel based on a depth of all or a portion of the code element 84 to generate a predetermined part of the coded pattern of signals. Thus, each code element 84 may include a hole, step, inset, groove, or the like, as shown in FIG. 4. Alternatively, as shown in FIG. 5, each code element 84 may comprise a step having a depth configured to actuate a sensor to generate a signal portion of the coded pattern of signals. Although the signal generated by each code element 84 has been described as corresponding to a measured depth of the code element 84, other measurable characteristics of the code element 84 are contemplated such as, for example, a width or angle of a code element 84. In other embodiments, a signal portion may be generated by configuring a code element 84 to mechanically set or actuate one or more flags or sensors located in specified positions in the ink loader.

A variety of encoding schemes may be implemented in the coded sensor feature 80 such as, for example, a binary encoding scheme. To implement a binary encoding scheme, each code element 84 of the coded sensor feature 80 may be configured to actuate a sensor to generate a signal having one of two possible values such as, for example, a "high" or "low" signal. This may be accomplished by assigning an actuation depth or a range of actuation depths for each code element 84. A first signal value may be generated by code elements 84 having a depth greater than the actuation depth or within an actuation depth range, and a second signal value may be generated by code elements 84 having a depth that is less than the actuation depth or that is outside of the actuation depth range. For example, an actuation depth range of 3.5 mm to 4.5 mm may be assigned. Code elements 84 intended to actuate a sensor to produce a "high" signal may then be formed having a depth that falls between 3.5 mm and 4.5 mm. Conversely, code elements 84 intended to actuate a sensor to produce a "low" signal may be formed having a depth that falls outside of the actuation depth range.

When implementing a binary encoding scheme, the one or more code words indicated by a coded sensor feature 80 comprises one or more n-bit binary code words where n corresponds to the number of code elements 84 assigned to indicate a particular binary code word. In this embodiment, each code element 84 and corresponding binary signal generated corresponds to a bit of a binary code word. Thus, with a code word comprised of n code element inputs, there are $2^n$ possible combinations of binary signals, or code words, which may be generated. For example, nine code elements assigned to indicate a single 9-bit binary code word may generate $2^9$, or 512, possible bit combinations, or code words. The plurality of code elements of a coded sensor feature 80 may be grouped in any number of ways to indicate a plurality of binary code words. For example, a coded sensor feature 80 having nine code elements may be configured to generate three 3-bit binary code words by assigning three groups of three code elements to each indicate a particular code word.

The number of code elements 84 assigned to indicate a particular binary code word may depend on the class of control/attribute information to be indicated by the code word and the number of possible variations, or subclasses, of the particular class of control/attribute information. For example, a class of information to be indicated by a particular code word may comprise color of an ink stick. The number of bits of a binary code word, and hence the number of code elements 84, needed to indicate a particular color of ink stick may correspond to the total number of possible colors of ink stick. For example, with four possible colors of ink sticks (yellow, cyan, magenta, and black), a 2-bit binary code word may be sufficient to indicate a particular color of ink stick. Similarly, a 3-bit binary code word may be assigned to indicate a class of control/attribute information in which there are up to eight possible variations.

Although a binary encoding scheme has been described, any suitable encoding scheme may be implemented. For example, by configuring the plurality of code elements 84 of a coded sensor feature 80 to actuate sensors to produce three or more possible signal values, base three and higher level encodings may be implemented. The preferred embodiment may be to determine the whole code word value by simultaneously sensing all elements, however, it is also possible to configure the system to allow code elements to be progressively sensed as the ink stick passes through a sensor station or area.

Figure 6:
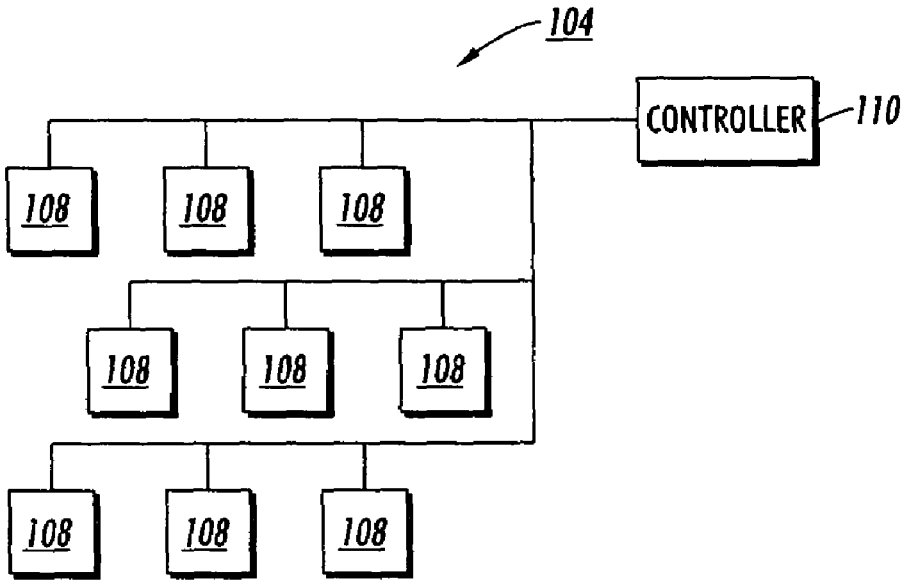
FIG. 6 is a schematic view of a sensor system for detecting the depth of code elements of the coded sensor feature shown in FIGS. 4 and 5.

Referring now to FIG. 6, the ink loader 100 may include a sensor system 104 designed to interface with the one or more coded sensor features 80 of an ink stick 30. FIG. 6 shows top schematic view of an embodiment of a sensor system 104 for measuring or detecting the depth the plurality of code elements 84 of an ink stick. The sensor system 104 includes one or more sensors 108 for sensing or detecting the depth of each code element 84 of the coded sensor feature 80 and generating a signal corresponding to the sensed depth, and a controller 110 for receiving the signals output by the sensors and decoding the signals received from the sensors. The depth of the code elements 84 may be detected optically, although any suitable detection method may be used. If optical detection is used, a retro-reflective material or coating may be added to each code element that provides the necessary reflective property to facilitate optical detection.

Figure 7:
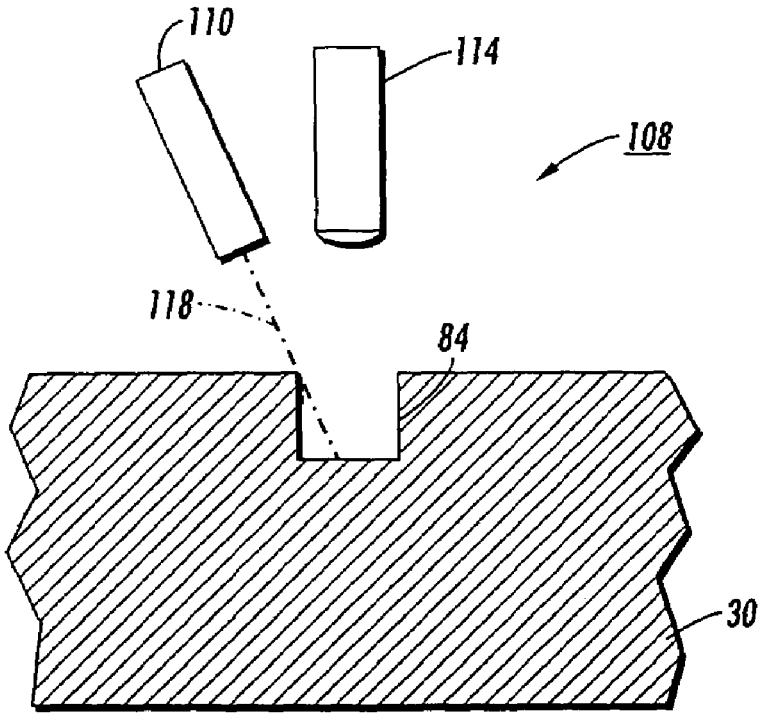
FIG. 7 is a side schematic view of a light emitter and detector of the sensor system of FIG. 6.

The sensor system 104 may be configured to simultaneously detect the depths of the code elements 84 of the coded sensor feature 80. Thus, in the embodiment shown, the sensor system 104 includes one sensor 108 arranged in the feed channel for each code element 84 of a coded sensor feature 80 although different sensor configurations are possible. Referring now to FIG. 7, each sensor 108 may comprise a light emitter 110 and a detector 114. The emitter 110 and the detector 114 are placed in the feed channel so that a collimated beam 118 emitted from the emitter 110 may be directed at a respective code element 84. The emitter 110 may be composed of a laser diode and a collimating lens (not shown) which collimates the laser beam 118 emitted from the laser diode toward a respective code element 84 of the coded sensor feature 80. An optical detector 114 is arranged in the feed channel to detect light incident upon a respective code element 84. The optical detector 114 may comprise a photodiode which converts detected light to electrical signals. The optical sensor 114 may include an amplifier (not shown) for amplifying the detected signal and an optical filter (not shown) tuned to the wavelength of light emitted by the emitter for eliminating stray light. While the detector 114 described comprises a photodiode, other types of light sensors, such as optical position sensors or photo-conductors, may be employed. The detector 114 operates to detect the signal strength of the light incident upon a code element 84 and generates an electric signal that corresponds to the detected signal strength. By correlating signal strength values to possible distances or depths of the code elements 84, the depth of a code element 84 may be determined.

In order to generate a binary signal, each sensor 108 may include a comparator (not shown). The output from the detector 114 corresponding to a detected depth of a code element 84 may be provided as an input to the comparator. An input corresponding to a threshold value, or actuation depth, may be provided as another input to the comparator. Comparator compares the detected depth to the actuation depth and generates a corresponding binary signal. In one embodiment, a "high" signal (binary 1) may be generated by the comparator if the sensed depth of a sensor region is greater than the actuation depth. A "low" signal (binary 0) may be generated if the sensed depth of the sensor regions is greater than the actuation depth. In another embodiment, an actuation depth range may be assigned for each sensor, such as, for example, 3.5 to 4.5 mm. In this embodiment, a "high" signal may be generated if the sensed depth falls within the actuation depth range, and a "low" signal may be generated if the sensed depth is greater than or less than the actuation depth range. Other sensors may be used, such as a mechanical switch or optical interrupter sensor, with moving actuator that is positioned and alters sensor states or values based on a dimension of the sensor element.

The binary signals output by the comparators may be received and processed by the imaging device controller 110 into one or more n-bit binary code words. For example, the one or more binary signals comprising a code word may be provided as inputs to predetermined bit positions in an input register, stored in memory, etc. An imaging device controller 110, having access to the code words generated by the coded sensor feature 80, may compare the generated code words to data stored in a data structure, or table. The data stored in the data structure may comprise a plurality of possible code words with associated information corresponding to each value. The associated information may comprise control/attribute information that pertains to the ink stick. The imaging device controller 110 may then enable or disable operations, optimize operations or influence or set operation parameters based on the control/attribute information associated with each code word generated by a coded sensor feature 80. For example, if a code word indicates that an ink stick is not compatible with or not intended to be used with the imaging device, the control system may generate an alert signal or message to an operator and/or service personnel.

Coded sensor features 80 may be used in combination with other keying, orientation and alignment features. This combination of features provides multiple mechanisms for ensuring proper loading of ink sticks and for providing control information pertaining to an ink stick to an imaging device control system. Alternatively, the coded sensor features may be used alone to provide the mechanisms for ensuring proper loading and conveying of information to the control system. Thus, ink sticks may be provided that can take a simplified form such as a rectangle or similar featureless shape. The only thing needed to distinguish ink sticks from one another may be the pattern or depth of the coded sensor features incorporated into the ink stick.

Figure 8:
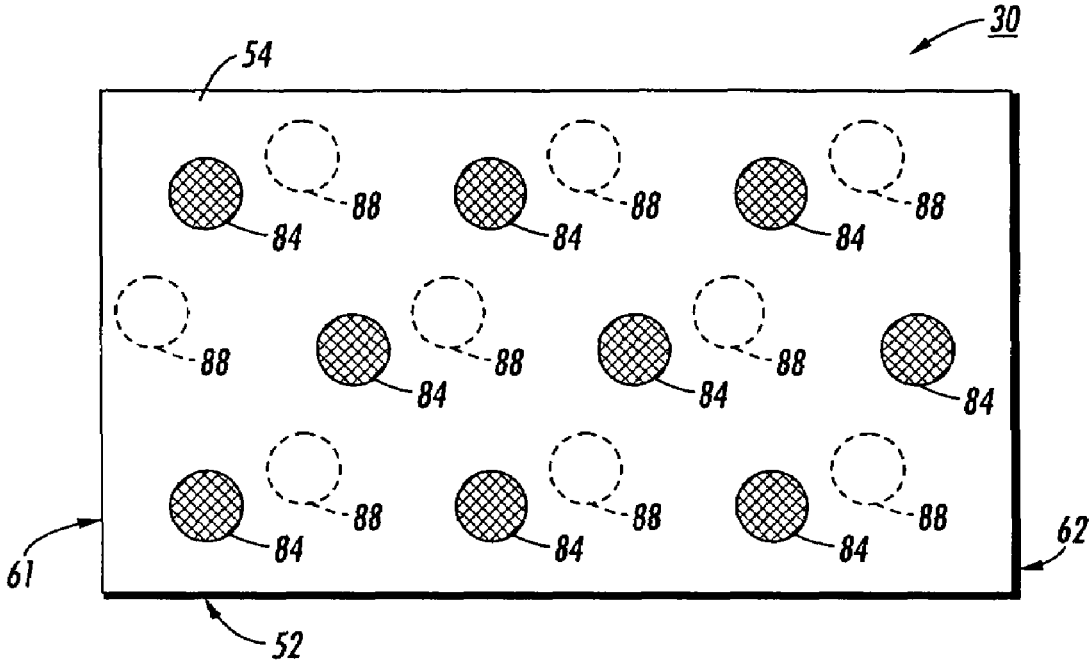
FIG. 8 is a top view of the ink stick of FIG. 4.

As mentioned above, a coded sensor feature 80 may be used to ensure proper loading of an ink stick. In one embodiment, a pattern of binary signals, or code word, generated by a coded sensor feature 80 may be used as an error code to indicate improper insertion and/or orientation of an ink stick in a feed channel or loading area. For example, referring to FIG. 8, the elements 88 show the orientation or pattern of the code elements 84 when the ink stick is rotated 180 degrees in a feed channel. As can be seen, none of the code elements 84 would be in a position to be detected by a corresponding sensor in the feed channel. Thus, the depths detected by each sensor may be an indication of improper orientation. In cases in which sensed depths less than an actuation depth or outside of an actuation depth range are converted to binary "low" signals, a code word comprised of all low values (0's) may be generated, i.e. 000000000. The imaging device controller may be programmed with the knowledge that when all of the one or more code words generated by a coded sensor feature 80 are comprised of bits of the same value, such as all 0's, an ink stick is not properly loaded in the ink loader. The controller may then disable operations and signal a user to take appropriate action.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink stick for use in an ink loader of an imaging device, the ink stick comprising:

an ink stick body configured to fit within the ink loader in the imaging device, the ink stick body having an exterior surface; and a coded sensor feature formed on the exterior surface of the ink stick body for conveying variable control/attribute information pertaining to the ink stick to a control system of the imaging device, the coded sensor feature including a plurality of code elements in predetermined positions on the exterior surface of the ink stick corresponding to sensor locations in a feed channel;

wherein the plurality of code elements is configured to actuate sensors at the sensor locations to generate a predetermined coded pattern of signals corresponding to the variable control information to be conveyed to the control system based on dimensions of the plurality of code elements.

2. The ink stick of claim 1, wherein the coded pattern of signals comprises one or more code words, each code word corresponding to different control/attribute information pertaining to the ink stick.

3. The ink stick of claim 2, wherein one or more code elements of the plurality of code elements are assigned to correspond to each of the one or more code words.

4. The ink stick of claim 3, wherein the one or more code words comprise binary code words; and wherein each code element of code sensor feature is assigned to correspond to a bit of the one or more binary code words.

5. The ink stick of claim 4, wherein each code element has a dimension configured to actuate the one or more sensors in the ink loader to produce a binary signal; and wherein a value of the assigned bit corresponding to each code element corresponds to a value of the binary signal produced by the code element.

6. The ink stick of claim 1, wherein the variable control/attribute information comprises ink stick color information.

7. The ink stick of claim 1, wherein the variable control/attribute information comprises imaging device calibration information.

8. The ink stick of claim 1, wherein the variable control/attribute information comprises marketing price information.

9. A system for an imaging device comprising:

a coded sensor feature formed on an exterior surface of an ink stick for conveying variable control/attribute information pertaining to the ink stick to a control system of the imaging device, the coded sensor feature including a plurality of code elements configured to produce a coded pattern of signals corresponding to the variable control information to be conveyed to the control system, the coded pattern of signals being comprised of signal parts, each signal part corresponding to a physical dimension of a code element;

a sensor system for detecting the dimension of each code element and generating the coded pattern of signals corresponding to the dimensions of the code elements; and a controller for receiving coded pattern of signals and decoding the coded pattern of signals to determine the variable control/attribute information to be associated with the ink stick.

10. The system of claim 9, wherein the coded pattern of signals generated comprises one or more code words, each code word corresponding to different control/attribute information pertaining to the ink stick.

11. The system of claim 10, wherein one or more code elements of the plurality of code elements are assigned to correspond to each of the one or more code words.

12. The system of claim 11, wherein the one or more code words comprise binary code words; and wherein each code element of the code sensor feature is assigned to correspond to a bit of the one or more binary code words.

13. The system of claim 12, wherein each code element has a dimension configured to actuate the one or more sensors in the ink loader to produce a binary signal; and wherein a value of the assigned bit corresponding to each code element corresponds to a value of the binary signal produced by the code element.

14. The system of claim 9, wherein the variable control/attribute information comprises ink stick color information.

15. The system of claim 9, wherein the variable control/attribute information comprises imaging device calibration information.

16. The system of claim 9, wherein the variable control/attribute information comprises marketing price information.

17. A method of feeding ink sticks in an ink loader of a phase change imaging device, the method comprising:

inserting at least one ink stick into the ink loader of a phase change imaging device;

detecting dimensions of a plurality of code elements formed into an exterior surface of the ink stick;

generating a coded pattern of signals corresponding to the plurality of dimensions detected;

decoding the coded pattern of signals to determine variable control/attribute information to be associated with the ink stick.

18. The method of claim 17, wherein decoding the coded pattern of signals comprises:

determining one or more code words contained in the coded pattern of signals; and determining the variable control/attribute information to be associated with each code word of the one or more code words.

19. The method of claim 17, further comprising:

influencing imaging operations based on the control/attribute information encoded in the coded pattern of signals.

20. The method of claim 19, wherein influencing imaging operations comprises:

generating an alert signal if the control/attribute information indicates that the ink stick is not designed for the imaging device.

* * * * *